US005658088A

United States Patent [19]

Samuelsson

[11] Patent Number: 5,658,088

[45] Date of Patent: Aug. 19, 1997

[54] METHOD OF OPERATING A ROAD ROLLER EQUIPPED WITH AN OPERATING LEVER

[75] Inventor: Sven-Erik Samuelsson, Nättraby, Sweden

[73] Assignee: Dynapac Heavy Equipment AB, Karlskrona, Sweden

[21] Appl. No.: 503,510

[22] Filed: Jul. 18, 1995

[30] Foreign Application Priority Data

Jul. 18, 1994 [SE] Sweden ..... 9402509

[51] Int. Cl.[6] ..... B60K 20/00; E01C 19/22

[52] U.S. Cl. ..... 404/72; 404/75; 404/122; 477/111

[58] Field of Search ..... 404/72, 75, 84.05, 404/117, 122; 477/110, 111, 125, 126, 904, 906

[56] References Cited

U.S. PATENT DOCUMENTS

| | | | |
|---|---|---|---|
| 3,412,659 | 11/1968 | Harbke et al. . | |
| 4,187,036 | 2/1980 | Haker et al. . | |
| 4,310,261 | 1/1982 | Opderbeck . | |
| 4,419,909 | 12/1983 | Opperud et al. | 477/126 |
| 4,680,983 | 7/1987 | Brown | 477/126 X |
| 4,773,217 | 9/1988 | Angot et al. . | |
| 5,450,768 | 9/1995 | Bulgrien et al. | 74/336 R |

FOREIGN PATENT DOCUMENTS

| | | | |
|---|---|---|---|
| 3705575 | 9/1988 | Germany | 404/117 |
| 4161506 | 6/1992 | Japan | 404/84.05 |

*Primary Examiner*—James Lisehora
*Attorney, Agent, or Firm*—Walter Ottesen

[57] ABSTRACT

A method for operating a hydraulically driven road roller, primarily for compacting bitumen, with which repeated passes are made over a bitumen coating and in which the roller's speed, acceleration, deceleration and direction of travel (forward or reverse) are selected with an operating lever 1 which, via a control panel 8, electrically acts on hydraulic valves (10, 11, 13) controlling a servo 14 which acts on a hydraulic pump 15 driving the propulsion motors of the road roller. The operating lever is moveable from a neutral position to full lever deflection and equipped with a forward/reverse switch 2 for selecting the roller driving direction. The speed of the road roller decreases at a programmed deceleration, when this switch is actuated, until the roller stops, followed by acceleration at a programmed rate to a programmed driving speed in the opposite direction. The roller is brought to standstill at the maximum permissible deceleration when the lever is pulled back.

8 Claims, 3 Drawing Sheets

METHOD OF OPERATING A ROAD ROLLER EQUIPPED WITH AN OPERATING LEVER

FIELD AND BACKGROUND OF THE INVENTION

The invention relates to a method for operating road rollers, primarily bitumen road rollers, by means of an operating lever, at an adjustable maximum speed achieved with adjustable acceleration and with which the forward or reverse driving direction is selected with a switch arranged so the road roller is automatically brought to standstill, at an adjustable deceleration, when the driving direction is switched from forward to reverse, whereupon the driving direction reverses, and the speed automatically increases at the preset acceleration until the preset maximum speed is reached. The corresponding procedure is used to change roller direction from reverse to forward drive. The operating lever is moveable from a neutral position to a position for maximum speed and the change in direction (forward/reverse) is selected with the switch. When necessary, the road roller can be stopped by moving the lever to the neutral position.

After a 20 to 100 meter stretch of road has been coated with bitumen, a bitumen road roller drives back and forth over the coating 2 to 8 times. This procedure requires frequent changes in the roller's driving direction. Here, maintaining an even speed as well as braking and accelerating at slow rates are essential to satisfactory compaction. Rapid deceleration and acceleration rates increase the risk of bitumen shearing with persistent cracks and impressions in the bitumen as a result.

As known, construction vehicles are equipped with operating levers to control a vehicle's steering to the right or to the left. The lever is equipped with a switch for selecting steering to the right or to the left and operates within a deflection range in which lever deflection is proportional to the vehicle's speed. The change from forward to reverse is made with a switch integrated into the lever. These prior art operating levers depend on the judgment and skill of the vehicle operator and the acceleration, deceleration and maximum speed of the vehicle depend on the speed at which the lever is moved to its maximum deflection. In bitumen rolling, it is especially important, as previously noted, for the road roller to accelerate and brake at slow rates and at an even speed. The driving speed of the road roller must also be kept constant at a rate selected for the operation to yield satisfactory compaction.

SUMMARY OF THE INVENTION

The object of the invention is to provide a method for operating a road roller in particular, by means of an operating lever which can be moved from a neutral position to a maximum deflection position, the forward or reverse driving direction being set with a switch integrated into the operating lever, the desired acceleration, deceleration and maximum speed being easily programmable with pushbuttons on an electronic unit associated with the operating lever, the road roller accelerating when the operating lever is moved from its neutral position to its maximum deflection position, at a rate proportional to the speed with which the lever is moved forward until the preset maximum speed is reached. This preset maximum speed is maintained until the forward/reverse switch is actuated. The road roller is then automatically brought to standstill at the preset rate. The road roller thereafter accelerates in the opposite direction at the preset rate until the preset maximum speed is attained.

The operator can stop the vehicle completely at any time by moving the lever to the neutral position. The vehicle will then come to a halt at the maximum permissible deceleration, which normally differs greatly from the slower deceleration when the forward/reverse switch is operated. In an emergency situation, the driver can accordingly stop the vehicle quickly, using a natural lever movement, with no need to disable the automatic operation mode first. The electronic unit also incorporates an emergency stop to bring the vehicle to an immediate halt. To prevent vehicle movement if the operating lever is inadvertently actuated, or when the lever is not in the neutral position, the forward/reverse switch must first be moved to an additional, nonlocking position for intentional vehicle operation to be achieved.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
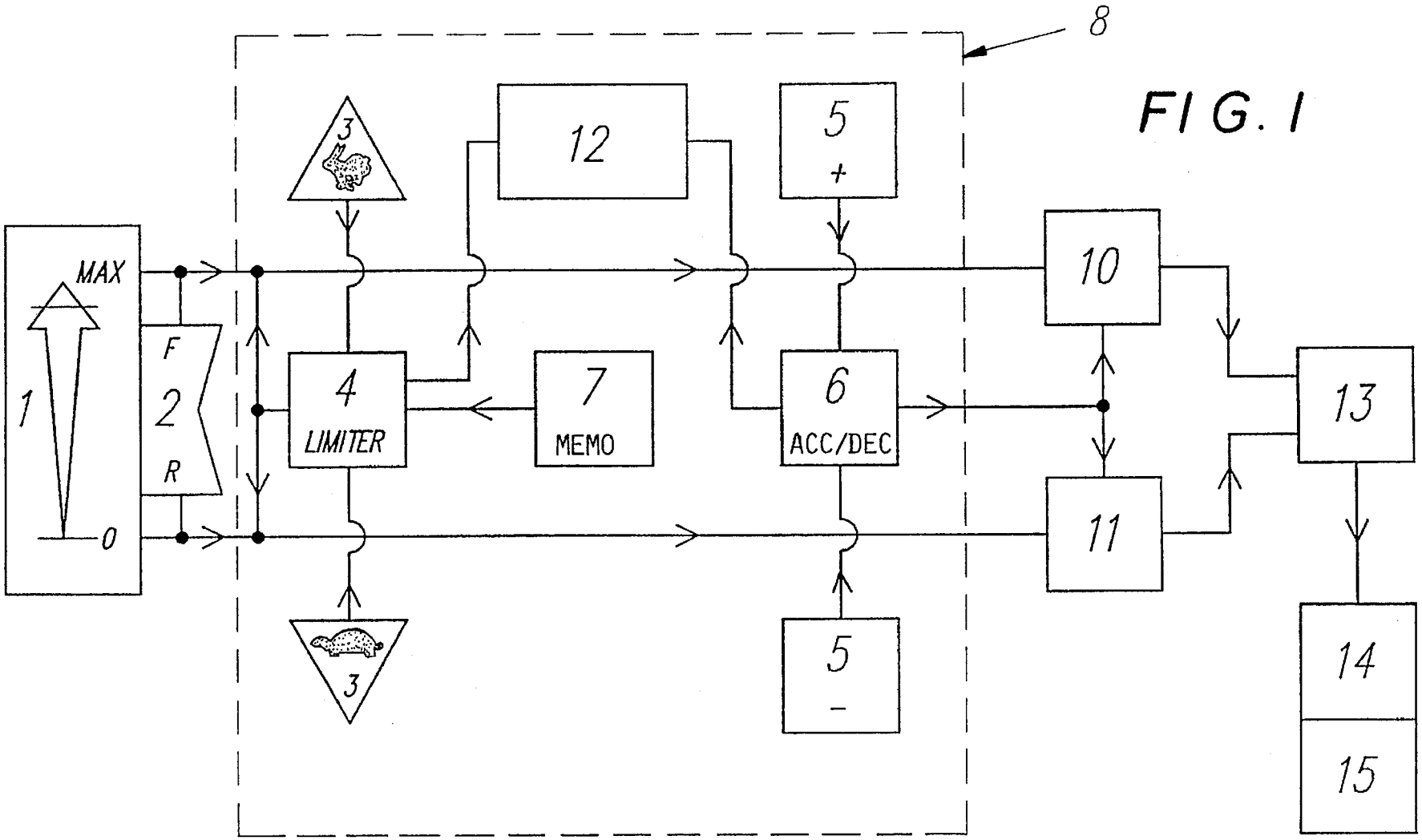
FIG. 1 is an block diagram showing the operating lever and the various functions of the electronic unit connected thereto.

In FIG. 1, the operating lever 1 is moveable between a neutral position 0 and a maximum deflection position MAX. A forward/reverse switch 2 has two fixed positions (forward F and reverse R) and is integrated into the handle of the operating lever 1. The switch 2 is also provided with an additional nonlocking position, for each position, which must first be selected when the lever is moved from its neutral position before either forward or reverse drive can be selected. This is to prevent the vehicle from moving if the operating lever is inadvertently actuated. The switch 2 determines which of the hydraulic valves 10 or 11 (see also FIG. 4) is to supply hydraulic pressure to set the hydraulic valve 13 which, in turn, allows fluid to pass to operate the pump servo 14.

When the operating lever 1 is moved forward, current to the valve (10 or 11) increases according to a time slope. The setting of the valve (10 or 11) and the fluid pressure downstream thereof increase in proportion to the intensity of said current. The valve 13 is set, and the fluid pressure then acts on the pump servo 14 which sets the hydraulic pump 15. Increased pressure increases the angle of the pump which increases its flow of fluid to the propulsion motors of the road roller which, accordingly, increase the road roller's speed.

The driving speed, which is adjustable from 2 km/h up to the road roller's maximum speed, is adjusted with the control buttons 3 on the electronic unit 6, that is, current can be adjusted from 0.6 to 1.2 ampere. The MEMO button 7 is used to program the driving speed. When the vehicle reaches the desired driving speed, activation of the MEMO button 7 stores the particular speed in a memory. This memory is activated when the limiter switch 4 is switched during road roller operation to the ON position, causing the road roller to assume the programmed speed when the operating lever is fully deflected.

If the limiter switch 4 is in the OFF position, however, full lever deflection causes the road roller to operate at its maximum speed. If the operator switches from the OFF to the ON position while the road roller is in motion, the roller will be decelerated according to the preset slope at a speed proportional to lever deflection and the stored driving speed. The corresponding events will occur if the operator switches from the ON to the OFF position while the road roller is in motion, that is, the road roller will accelerate according to the preset slope at a speed proportional to the lever deflection.

The rate of acceleration/deceleration (slope) can be increased or reduced with the 5+ and 5– buttons, respectively. The rate is shown on a display 12 if the display has been set to mode A with the button 6. This rate determines how rapidly current to valve 10 or 11 increases or decreases. When the display is not in mode A but the switch is in the ON position, then an L is shown on the display, indicating that the programmed driving speed has been enabled.

Figure 2:
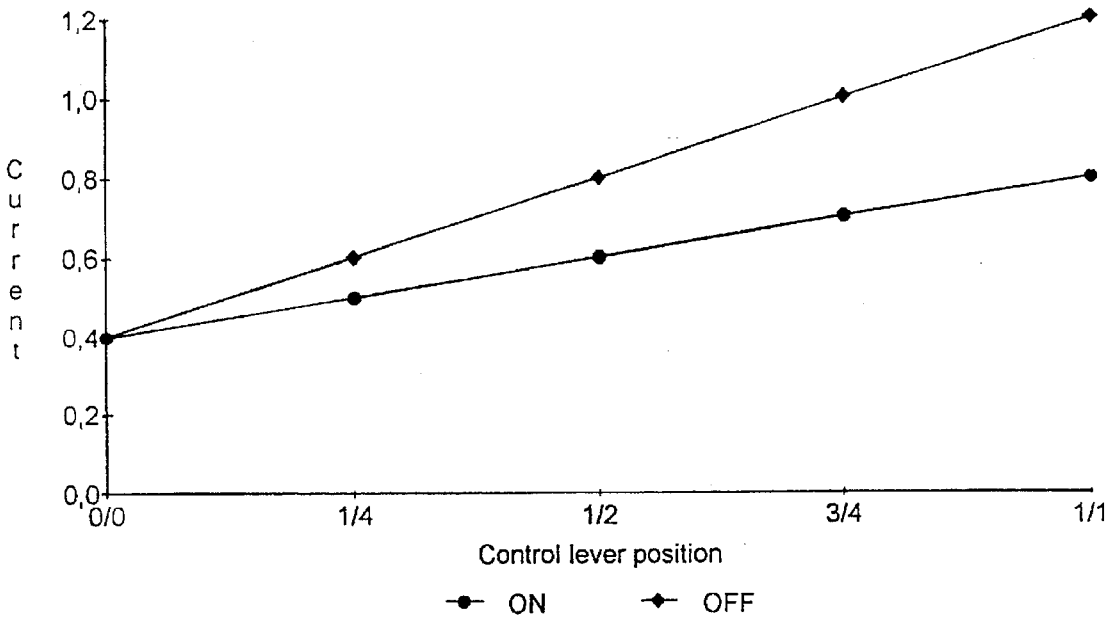
FIG. 2 is a diagram showing the current supplied to the output hydraulic valves as a function of operating lever deflection.

FIG. 2 is a diagram showing how current to the valves (10, 11) increases with increasing lever deflection. The upper curve represents the increase in current when the limiter switch 4 is in the OFF position, and the lower curve is an example of the slope when the limiter switch 4 is in the ON position. When the lever is fully deflected, current can be limited between 0.6 and 1.2 ampere.

Figure 3:
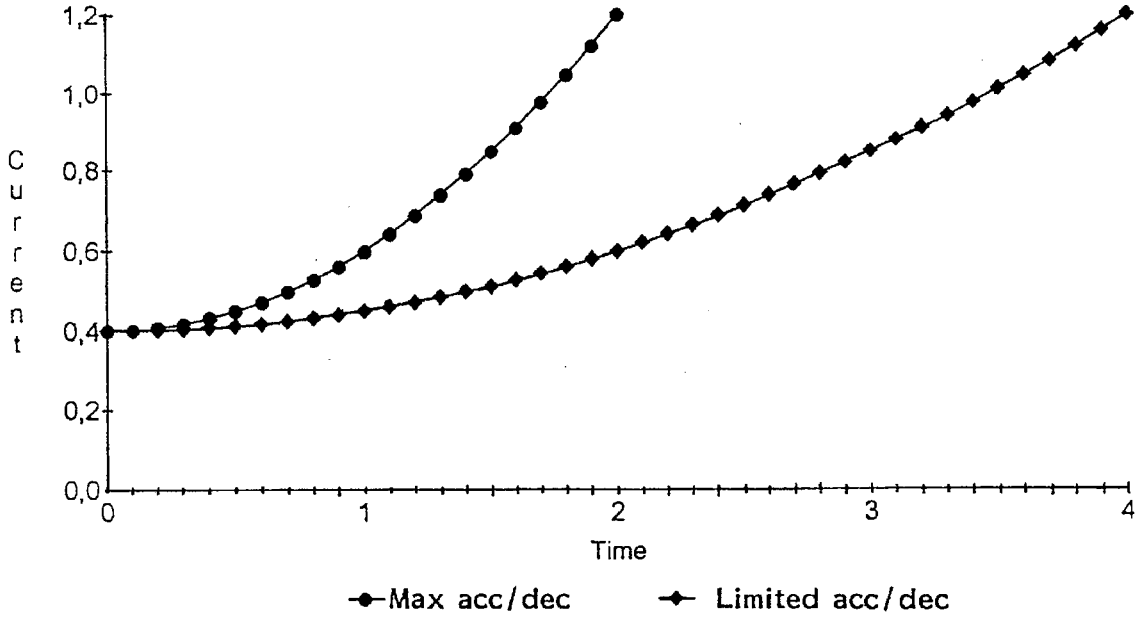
FIG. 3 is a diagram showing the current supplied to the output hydraulic valves as a function of time; and, FIG. 4 is a hydraulic circuit block diagram for the propulsion of the road roller.

FIG. 3 is a diagram showing the increase in current as a function of time, that is, slopes for acceleration/deceleration, the upper curve representing the fastest possible rate for acceleration/deceleration and the lower curve showing a restricted rate.

Figure 4:
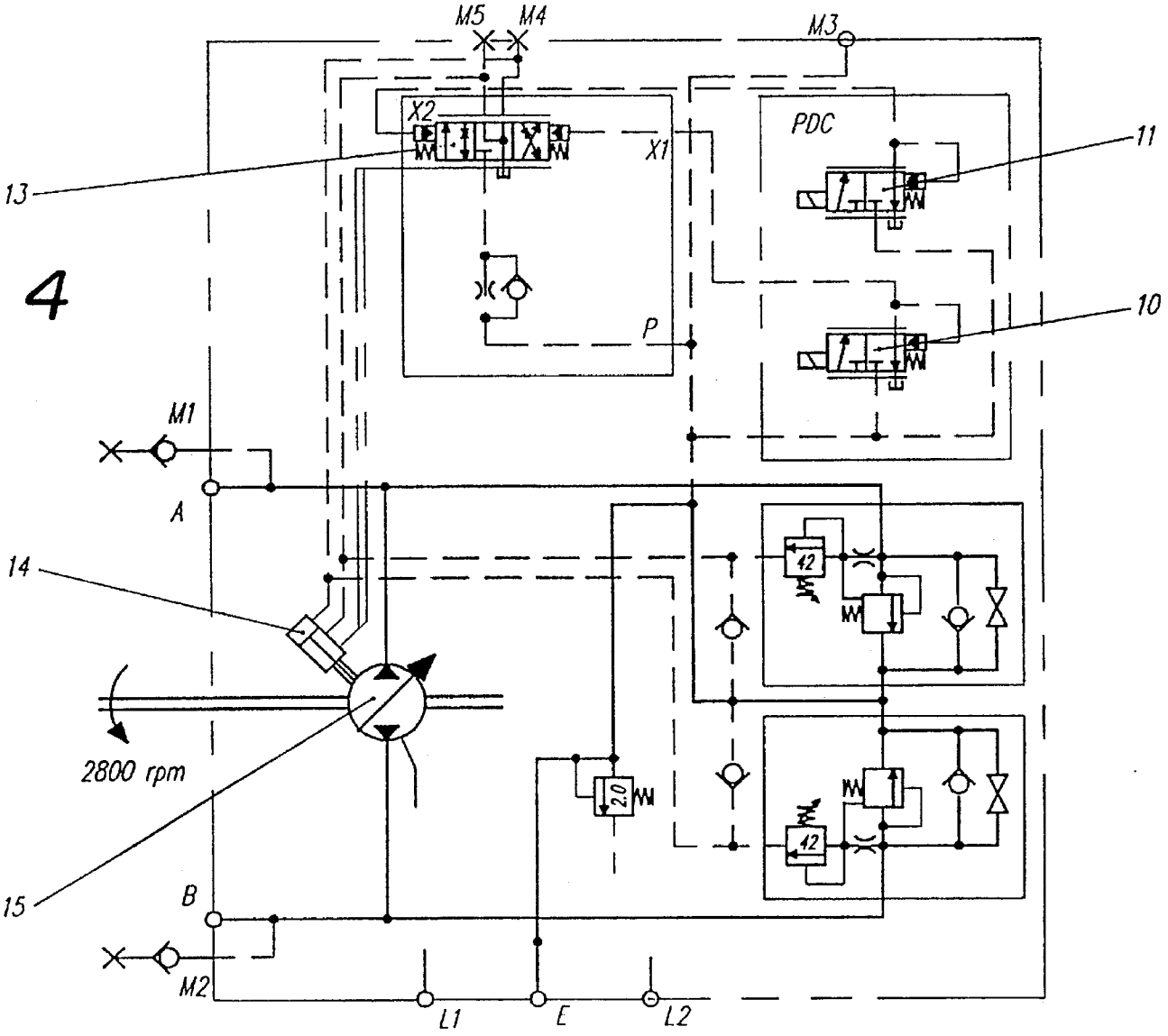

FIG. 4 is a hydraulic circuit diagram of the propulsion of the road roller in which the hydraulic valve 10 acts on valve 13 for forward drive and on valve 11 for reverse drive. Hydraulic pressure from the valve 13 acts on the servo 14 which sets the pump 15 as previously noted.

The invention is not restricted to the embodiment described above and shown in FIGS. 1 to 4 but can be modified and still remain within the scope of the invention. The invention is therefore also applicable to other types of pump control and servos, for example, a proportional valve on a mechanical servo or the like. Controls of other types than those noted above, for example, handles, knobs or potentiometers, can also be used.

It is understood that the foregoing description is that of the preferred embodiments of the invention and that various changes and modifications may be made thereto without departing from the spirit and scope of the invention as defined in the appended claims.

What is claimed is:

1. A method of operating a hydraulically driven road roller, primarily for compacting bitumen, with which repeated passes are made over a bitumen coating and wherein the speed, acceleration, deceleration and direction of travel, forward or reverse of the road roller, are selected with an operating lever which, via a control panel, electrically acts on hydraulic valves controlling a servo which, in turn, acts on a hydraulic pump driving the propulsion motors of the road roller, the operating lever being equipped with a handle and being movable from a deflected position to a neutral position to provide a maximum permissible deceleration to standstill, the method comprising the steps of:

moving the operating lever from the neutral position to a position of maximum lever deflection;

selecting the driving direction of said road roller with a forward/reverse switch and said switch being integrated into the handle of the operating lever;

accelerating the road roller at a speed proportional to the speed at which said operating lever is deflected when said operating lever is moved from the neutral position to maximum lever deflection;

driving the road roller forward at a programmed driving speed with the operating lever in maximum deflection and the forward/reverse switch in the forward position;

moving the forward/reverse switch into the reverse position and bringing the road roller to standstill at a programmed rate and then accelerating said road roller at a programmed rate to the programmed speed in the rearward driving direction;

driving said road roller forward without maximum lever deflection and when the forward/reverse switch is moved into the reverse position, the speed attained by the road roller in relation to the programmed driving speed is limited in proportion to lever deflection; and, stopping said road roller at any time by moving the operating lever to the neutral position to bring the road roller to standstill at the maximum permissible deceleration.

2. The method of claim 1, wherein functions of the operating lever are controlled by and adjusted with push-buttons on a control panel incorporating electronics needed therefor and a display showing programmed rates and road roller speed.

3. The method of claim 2, wherein said forward/reverse switch has a first position corresponding to forward movement of said road roller and a second position corresponding to reverse movement of said road roller; and, each of said first and second positions of said forward/reverse switch has an additional, nonlocking contact position which must first be manually engaged when the operating lever is moved from its neutral position for forward drive of the operating road roller to start.

4. The method of claim 3, wherein said forward/reverse switch is located on the control panel or in its vicinity.

5. The method of claim 2, wherein a limiter switch has two positions, "on" and "off" in which the "on" position permits the setting of the driving speed with two symbol-designated buttons, one marked with a hare for increasing speed and the other marked with a tortoise for reducing speed with the speed set with said buttons being stored in a memory with a memo button.

6. The method of claim 5, wherein the "on" position of said limiter switch causes the programmed driving speed to be achieved when the operating lever is fully deflected, and the "off" position enables the roller operator to drive the road roller at up to its maximum speed without being affected by programmed rates.

7. The method of claim 2, wherein a rate for roller acceleration or deceleration can be set with a button (ACC/DEC), whereby an increase or decrease in acceleration/deceleration is made with two buttons (5+ and 5–) with the rates being shown on a display.

8. The method of claim 2, wherein a switch in the cab must be actuated by the weight of the driver before said operating lever can be activated.

* * * * *